United States Patent [19]

van Es

[11] 4,397,390

[45] Aug. 9, 1983

[54] CONTAINER FOR PACKED WIRE BUNDLES

[76] Inventor: Kees van Es, Exlostraat 81, 2545 XN The Hague, Netherlands

[21] Appl. No.: 255,483

[22] Filed: Apr. 20, 1981

[30] Foreign Application Priority Data

Apr. 23, 1980 [NL] Netherlands ..... 8002366

[51] Int. Cl.[3] ..... B65D 85/66; B65D 85/671

[52] U.S. Cl. ..... 206/391; 206/392; 220/20.5; 220/22; 229/15

[58] Field of Search ..... 206/392, 391; 229/15, 229/27, 28 R; 242/159, 55.3; 220/20.5, 21, 22

[56] References Cited

U.S. PATENT DOCUMENTS

| | | | |
|---|---|---|---|
| 2,382,240 | 8/1945 | Lesavoy et al. | 229/15 |
| 2,472,079 | 6/1949 | James et al. | 229/15 |
| 3,306,439 | 2/1967 | Storey | 206/392 |
| 3,752,385 | 8/1973 | Woodgate | 229/15 |

FOREIGN PATENT DOCUMENTS

| | | | |
|---|---|---|---|
| 2756902 | 12/1977 | Fed. Rep. of Germany . | |
| 1191582 | 2/1958 | France | 229/15 |
| 6412009 | 4/1965 | Netherlands . | |
| 297571 | 9/1928 | United Kingdom . | |

*Primary Examiner*—Joseph Man-Fu Moy

[57] ABSTRACT

The invention relates to a container for storing a number of wire bundles, each bundle being packed into a rectangular flat box having a lower wall, four side walls and an upper wall into which a central opening can be made.

The container comprises a lower wall and a number of side walls, whereby the interior space of the container is divided by a number of partition walls, which run parallel to the side walls into a central compartment and a number of further compartments equal to the number of packed wire bundles which may be stored in the said container. Each of said partition walls has an opening which, after inserting a wire filled box into its respective compartment, coincides with the central opening in the upper wall of said box, so that the wire may be pulled out of said box through said central opening and the respective partition wall opening without damaging the box.

3 Claims, 3 Drawing Figures

CONTAINER FOR PACKED WIRE BUNDLES

The invention relates to a container for storing a number of wire bundles, each packed in a rectangular flat box having a lower wall, four side walls and an upper wall into which a central opening can be made.

Copper wire in the form of electrical wire or installation wire used in electrotechnical installations and networks is supplied in rectangular flat cardboard boxes having a lower wall, four side walls and an upper wall, part of which may be removed along a prefabricated weakening line such that a central generally circular opening is made in the upper wall.

In practice the cardboard boxes, which have to endure a lot during operations in electrotechnical installations, are weakened during use, develop cracks and tears and therefore lose their capability as a protective package. The wear of the box is accelerated due to the fact that the wire, which is drawn out of the box through the central opening in the upper wall, cuts into the card board along the edge of said opening. The result of this wear is that the last meters of wire in the box are not protected adequately and are therefore susceptible to damage.

A further disadvantage is that after the majority of the wire is consumed, the remaining wire in the box does not have sufficient weight to keep the box in position when wire is drawn out of the box. The result is that the entire box is dragged which is very inconvenient.

As a result of the damage to the wire, caused by the wear of said box, and as a result of the fact that during the consumption of the last meters of wire the box is not kept in place, the last meters of wire are generally disposed and a new box is opened. This leads to a considerable waste of wire.

An object of the invention is to eliminate these disadvantages.

The object of the present invention is accomplished by a container adapted to store a number of wire bundles, each of which is packed in a rectangular flat box having a lower wall, four side walls and an upper wall into which a central opening can be made. The container comprises a lower wall and a number of side walls, whereby the interior space of the container is divided by a number of partition walls, parallel to said side walls, into a number of compartments equal to the number of packed wire bundles which may be stored into said container and a central compartment. Each of the partition walls is provided with an opening which, after inserting a box into the compartment, coincides with the central opening in the upper wall of the box.

The container according to the present invention protects the boxes so that they are not weakened, at least not so easily and do not tear, so that the bundle of wir in the box is protected upto and including the last meters. When the wire is pulled out through the central opening in the box the wire is guided along the edge of the coinciding opening in the partition wall adjacent the box and therefore the chance of tearing the box by cutting it with the wire is reduced. Accordingly the wire is protected and not damaged up to the last meters. Moreover, since the container has its own weight as well as the fact that the wire containing boxes in the other compartments add to the weight of the whole combination the chance that the container will be pulled along when the wire is drawn out, is greatly reduced.

Electrotechnical installation requires in general, four different colored bundles of wire, for instance blue, brown, black and yellow/green wires. A preferred embodiment of the container according to the present invention is therefore characterized in that the side walls of the container are perpendicular to the lower wall and to the adjacent side walls, whereby the partition walls divide the container into four compartments for receiving wire bundles packed in boxes and a central compartment.

Further characteristics and advantages of the container according to the invention will be described with reference to the attached drawings.

Figure 1:
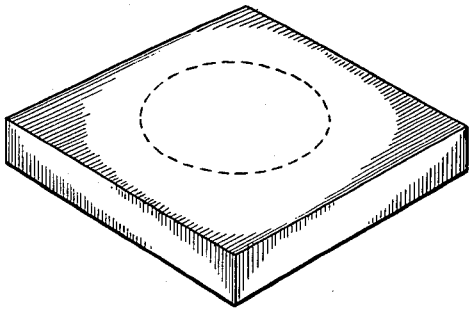
FIG. 1 shows a rectangular flat box of the type in which installation wire is supplied.

FIG. 1 shows a rectangular flat box for packaging installation wire comprising a lower wall, four side walls and an upper wall. The box contains for instance 100 meters of installation wire with a copper diameter of 1.5 or 2.5 mm, which is wound in a coil. When the wire is to be used the central part of the upper wall, indicated by a dash line in FIG. 1 is torn off along the weakening or incision lines, so that a generally circular central opening results through which the wire may be pulled.

Thereafter the box is inserted into one of the compartments of the container according to the invention such, that the central opening of the box coincides with the opening in the respective partition wall forming that compartment.

Figure 2:
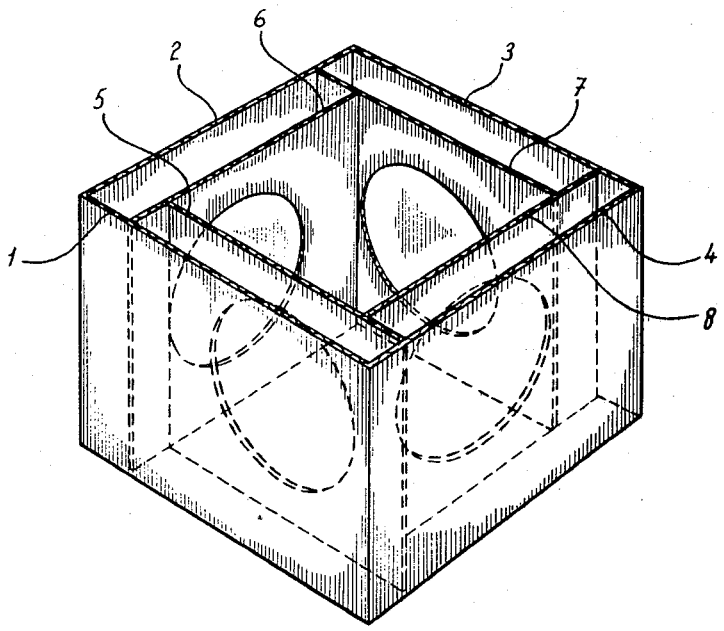
FIG. 2 shows an embodiment of a container according to the invention in perspective view.

FIG. 2 shows an embodiment of a container according to the present invention for use with four wire containing boxes. The container comprises a bottom wall, not visible and four side walls 1, 2, 3 and 4. Partition walls 5, 6, 7 and 8, each of which is parallel to one of said side walls, divide the interior space of the container into four compartments, the dimensions of which correspond to the outer dimensions of the flat boxes in which the wire is packed, and a central compartment.

Figure 3:
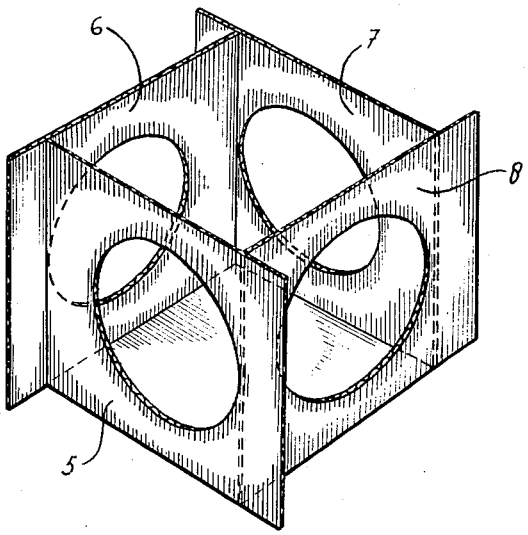
FIG. 3 shows the separate partition walls in the position in which they are installed in the container illustrated in FIG. 2.

FIG. 3 shows separately partition walls 5, 6, 7 and 8 in the same position in which they are installed in the container as illustrated in FIG. 2. Each of the partition walls is provided with a circular opening positioned such, that after inserting the wire containing boxes into their individual compartments the central openings in the upper walls of the boxes coincide with the openings in the partition walls.

After inserting the boxes in their respective compartments the ends of the wires are pulled through their respective openings in the partition walls through the central compartment and out of the container for use.

Although a preferred embodiment of the invention is above described it will be clear that other embodiments are possible. It is for instance possible to embody the container with a triangular or pentagonal lower wall carrying three or five side walls respectively and furthermore three or five partition walls which divide the interior of the container into three or five compartments respectively and a central compartment.

In a further embodiment of the present invention which is not illustrated in detail, a further bottom plate is installed below the lower wall of the container such that the distance between the bottom plate and the lower wall is equal to the distance between the lower and upper wall of a box. The bottom plate is connected to the lower wall of the container by means of three side elements and the bottom plate is provided with a circular opening positioned so that when a box is inserted into the space between the lower wall and the bottom plate, it coincides with the opening in the upper wall of the box.

The container according to the invention may be fabricated from several materials such as wood, metal or plastic. Preferably the container is embodied with such strength, that it is possible to stand on the container after the container is filled with boxes, so that said container may be used as a footstool during installation activities.

Although separate handles could be attached to the container according to the present invention it is also possible to lift the container by inserting one hand into one of the openings into one of the partition walls such that the figures of the hand are placed in the opening while the thumb is resting against the upper edge of the respective partition.

During installation the central compartment of the container offers space for temporarily storing small tools, loose wire ends and other materials such as wire connectors etc.

Although a preferred embodiment of the invention is described above it will be clear that further modifications and variations are possible within the scope of the invention.

I claim:

1. A container for protecting a number of wire bundles from damage, each of said wire bundles being packed in a flat rectangular box having a bottom, four side walls and a top in which a central opening can be made, wherein said container comprises a lower wall and a plurality of side walls perpendicular to said lower wall, the interior space of said container being divided into a number of rectangular compartments and a central compartment by a plurality of partition members, said partition members extending from the lower wall to the top of said side walls and being parallel thereto, the number of said rectangular compartments so formed being equal to the number of wire bundles to be stored in said container, and each of said partition members being provided with an opening which coincide with the central opening in the upper wall of said flat rectangular boxes.

2. A container according to claim 1, wherein said partition walls divide said container into four compartments for receiving said flat rectangular boxes and a central compartment.

3. The container according to claims 1 and 2 which includes a further compartment below the lower wall of said container for housing a further flat rectangular box, said further compartment being formed by three side elements located adjacent three side edges of the lower wall and a bottom plate positioned under said three side elements, the lower wall of said container being provided with a circular opening which coincides with the central opening in the upper wall of said further flat rectangular box.

* * * * *